US007488062B2

(12) United States Patent
Boesten et al.

(10) Patent No.: US 7,488,062 B2
(45) Date of Patent: Feb. 10, 2009

(54) PRINTING METHOD FOR USE IN AN INKJET PRINTER AND AN INKJET PRINTER WHICH HAS BEEN MODIFIED FOR THE PRINTING METHOD

(75) Inventors: Hubertus M. J. M. Boesten, Melick (NL); Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 400 days.

(21) Appl. No.: 11/345,330

(22) Filed: Feb. 2, 2006

(65) Prior Publication Data

US 2006/0170744 A1 Aug. 3, 2006

(30) Foreign Application Priority Data

Feb. 3, 2005 (NL) ..... 1028178
Sep. 7, 2005 (EP) ..... 05108188

(51) Int. Cl.
*B41J 2/19* (2006.01)

(52) U.S. Cl. ..... 347/92

(58) Field of Classification Search ..... 347/14, 347/19, 23, 68, 92
See application file for complete search history.

(56) References Cited

U.S. PATENT DOCUMENTS 4,293,867 A * 10/1981 Isayama ..... 347/92
4,323,908 A * 4/1982 Lee et al. ..... 347/27
4,498,088 A * 2/1985 Kanayama ..... 347/92
4,509,057 A * 4/1985 Sohl et al. ..... 347/19
4,518,974 A * 5/1985 Isayama ..... 347/92
4,625,220 A * 11/1986 Nagashima ..... 347/19
4,695,852 A * 9/1987 Scardovi ..... 347/14
6,139,133 A * 10/2000 Ishikawa ..... 347/71
6,682,162 B2 * 1/2004 Simons et al. ..... 347/19

FOREIGN PATENT DOCUMENTS

JP 59176056 5/1984
JP 01078846 3/1989

* cited by examiner

*Primary Examiner*—Anh T. N. Vo
(74) *Attorney, Agent, or Firm*—Birch, Stewart, Kolasch & Birch, LLP

(57) ABSTRACT

A printing method for application in an inkjet printer containing a substantially closed ink chamber and a nozzle, said ink chamber being operationally connected to an electro-mechanical converter, which includes the steps of printing an image for the purposes of which the converter is actuated according to a predetermined printing strategy in order to eject ink drops from the nozzle for the formation of the image onto a carrier; detecting the presence of an obstruction, in particular a gas bubble, inside the ink chamber during printing: interrupting the printing process: modifying the printing strategy in such a way that the obstruction will not produce ink chamber failure while the process of printing the image continues by actuating the converter using the modified printing strategy: and continuing the printing process by application of the modified printing strategy. An inkjet printer which has been modified for using the present method is also provided.

13 Claims, 6 Drawing Sheets

PRINTING METHOD FOR USE IN AN INKJET PRINTER AND AN INKJET PRINTER WHICH HAS BEEN MODIFIED FOR THE PRINTING METHOD

This application claims the benefit of the Dutch Application No. 1028178 filed on Feb. 3, 2005 and the European Patent Application No. 05108188.3 filed on Sep. 7, 2005, which are hereby incorporated by reference.

BACKGROUND OF THE INVENTION

The present invention relates to a printing method for application in an inkjet printer containing a substantially closed ink chamber provided with a nozzle, said ink chamber being operationally connected to an electro-mechanical converter, the method comprising: printing an image for the purposes of which the converter is actuated according to a predetermined printing strategy in order to eject ink drops from the nozzle onto a carrier for the formation of the image thereon, detecting the presence of an obstruction, for example, a gas bubble, inside the ink chamber during printing, and subsequently interrupting the printing process. The present invention also relates to an inkjet printer which has been modified so that the present method can be automatically applied.

A method of this kind is known from U.S. Pat. No. 4,695,852 (Scardovi, 1987). The printer in question comprises an ink chamber which is connected to a piezo-electrical converter. By actuating this converter, pressure waves are generated inside the ink chamber, said pressure waves in turn being able to cause ink drops to be ejected from the nozzle. By actuating the converter image-wise, an image, made up of individual ink drops, may thus be formed on a carrier. To this end, the printer comprises a calculation unit which determines an adequate printing strategy prior to printing the image. This printing strategy comprises information on the times at which and the actuation pulse with which the ink chamber is to be actuated for the correct ink drop to take on the required pixel on the carrier. In the known method, the inkjet printer comprises only one ink chamber, said ink chamber being part of a printhead which is a fixed arrangement in the printer. The carrier is led along the printhead in a number of scanning movements, so that ultimately, the entire carrier may be provided with ink drops. In other types of inkjet printers, the printhead is a movable arrangement in the printer, so that it may make this scanning movement in an initial (main) scanning direction. As the printheads usually do not extend along the entire length of the carrier, the carrier is usually moved along the printhead in a number of (sub) scanning directions. The combination of both scanning movements means that the entire carrier may be provided with ink drops, despite the limited dimensions of the printhead. As is generally known from the prior art, it will be necessary to take these scanning movements into account when determining the printing strategy, in particular when determining the exact times at which the ink drops are to be ejected from the ink chamber, as this determines the position the printhead takes on relative to the carrier at each moment during the printing process. Prior to the image being printed, a strategy is thus determined with which the image may, in principle, i.e., if no unforeseen problems occur, be printed. According to one embodiment, a total image to be printed, e.g., the image of a photograph in A3 format, is divided into a number of partial images, where the printing strategy is determined per partial image, prior to it being printed. An example of such partial image is a strip of the total image, said strip having a width that is equal to the width of an image that may be printed in one scan action of the printhead. In the known printer, a detection circuit has been provided to determine whether an obstruction, i.e., anything that hinders the inkdrop formation process, in particular a gas bubble, is present in the chamber while an image is being printed (i.e. immediately after the piezo-electrical converter has been actuated in order to provide the first pixel on the carrier with an ink drop). If such an obstruction is detected, the printing process will be interrupted, as such obstructions usually have an adverse effect on the drop formation process, for example, ink drops that are formed which are too small or which do not have the correct injection speed. This means that ink drops of an unintended size end up on the carrier or on an unintended location of the carrier, which may result in print artifacts. Furthermore, it is known that where the ink chamber is permanently loaded, an obstruction will usually produce ink chamber failure (i.e. a state in which the ink chamber is no longer able to eject an ink drop when the converter is actuated). Thus it is known that gas bubbles may grow quickly due to the pressure waves being generated. From a certain size upwards, it will no longer be possible to eject ink drops from the ink chamber since their presence interferes too much with the acoustics in the chamber such that, for example, all acoustic energy is absorbed or reflected by the gas bubble. Failure of the ink chamber will virtually always produce highly undesirable print artifacts. In order to prevent this as far as possible, the obstruction is removed from the ink chamber after the printing process has been interrupted, for example by purging the ink chamber with fresh ink, after which the printing process may be resumed.

However, the known method does have a number of major disadvantages. Interrupting the printing process is relatively time-consuming, which is considered a nuisance by any user of the printer. Furthermore, a relatively large amount of ink is required to ensure that the obstruction is indeed removed during the purging operation. Another important disadvantage is that joining errors often occur between the part of the image printed before the obstruction was detected and the part printed after the obstruction has been removed. Thus, to enable the ink chamber to be purged with fresh ink, it is moved to a purge station, so that the purging ink cannot soil the carrier. After the purging operation, the printhead will need to be repositioned in the exact same place where it was when the printing process was interrupted. Here, it is virtually impossible to prevent positioning errors in the region of 20 to 200 μm, often producing visible joining errors.

SUMMARY OF THE INVENTION

The present invention obviates the problems described above and provides a method for modifying the printing strategy so that an obstruction will not produce ink chamber failure while the process of printing the image will continue by the actuation of the converter using the modified printing strategy, and continuing the printing process by application of the modified printing strategy.

The present invention is partially based on the recognition that an obstruction inside the ink chamber does not necessarily need to produce visible print artifacts. Often, the ink chamber may still be used to eject ink drops despite the presence of an obstruction, without producing visible print artifacts. Research has shown that obstructions, in particular gas bubbles inside the ink chamber, may grow the more frequently the ink chamber (or at least its associated converter) is actuated after the obstruction had initially occurred. Ultimately, a point may be reached where the obstruction is so strong that the ink chamber will fail, i.e. it will no longer be able to eject ink drops despite actuation of its associated converter. Further research has shown that the self-reinforcing effect of an obstruction can be obviated (and even prevented) by reducing the load on the ink chamber, e.g. by modifying the printing strategy in such a way that fewer ink drops are ejected from the ink chamber than originally provided for.

According to the present invention, all existing knowledge and insight is now advantageously used. When an obstruction is detected, the printing strategy is modified. The modified printing strategy is chosen in such a way that the obstruction will not grow to a size that will cause the ink chamber to fail. At a high actuation frequency of the converter, e.g., 20 kHz, a gas bubble, for example, will quickly grow to a size that will cause the chamber to fail. If previous research has shown, for example, that this gas bubble will take on a small equilibrium size at a frequency of 10 kHz, at which size the ink chamber will still be available for printing, then it will be possible to modify the printing strategy in such a way that this ink chamber will only be loaded at a maximum frequency of 10 kHz. Surprisingly, the presence of an obstruction, as long as it is sufficiently small (for the ink chamber not to fail), has such a minor effect on the drop formation process that it will not usually produce visible print artifacts. In other words, despite the presence of the obstruction in the chamber, the printing process may be continued as normal using the ink chamber. This means that the printing strategy will have been modified, for example in such a way that a smaller number of ink drops may be ejected from the nozzle per time unit. The major advantage of this method is that the ink chamber is still available for printing without a purge operation being required. Furthermore, the modified printing strategy may be combined with another method of scanning the printhead relative to the carrier. In this way, it is still possible to provide ink drops to each pixel of the image on the carrier and no information needs to be lost at all. The printing strategy may be modified very quickly, for example by using modifications stored in the printer memory. It will also be possible for a powerful processor to calculate a new strategy very quickly, immediately after the obstruction has been detected, and the new strategy may usually be implemented within a few seconds. This then often eliminates the need for a noticeable interruption of the printing process. The present invention allows the printing process to continue using an ink chamber in which the obstruction is present, without producing visible print artifacts. The present invention implies knowing the correlation between the obstruction present, its effect on the drop formation process, and the behavior of this obstruction (growing and thus causing the chamber to fail, shrinking, reaching equilibrium) as a function of the printing strategy. The knowledge required to apply the present invention may be easily determined by experimentation. An example of this has been included in the further description of the invention.

It should be noted, moreover, that modification of the actuation of the piezo-electrical converter to the measured state of the ink chamber is known from patent EP 1 378 359. However, it is not known from said patent that this actuation (and subsequent actuations) can be modified in such a way that the ink chamber will not fail during the process of printing the envisaged image.

According to one embodiment, the predetermined printing strategy is modified by changing the frequency at which the converter is actuated, i.e. the average number of actuations per second directed at the ejection of ink droplets. The load on the ink chamber in this embodiment is modified by modifying the way in which the converter is actuated. Research has shown that by modifying the frequency of the actuation pulses at which the converter is actuated, e.g. by lowering the amount of ink droplet ejections by 50%, it is very easy to provide a strategy that will not produce ink chamber failure. Thus it has been shown that by reducing the frequency, it is possible to prevent the gas bubble from growing larger and larger. A lower amplitude of the actuation pulse may have the same effect, but this also leads to droplets of other sizes or speed which has to be taken into account when devising an alternative print strategy.

According to another embodiment of the present invention, the printing process is automatically interrupted when it is detected that the process of printing the entire image by application of the predetermined printing strategy would produce ink chamber failure during this printing process. In this embodiment, it is first determined, before the printing process is interrupted, whether the present obstruction will actually produce ink chamber failure, if the printing process were continued using the original printing strategy. If the obstruction is, for example, a small gas bubble, and the ink chamber in question is only required to eject a few more drops of ink in order to complete the image, then this bubble will normally not grow to a size that will cause the ink chamber to fail. Interrupting the printing process and modifying the printing strategy will then not be required despite the presence of the obstruction inside the ink chamber. If, however, continuing the printing process by application of the predetermined printing strategy will produce ink chamber failure within the envisaged image, then the printing process will be interrupted and the strategy will be modified according to the present invention. The advantage of this embodiment is that the printing process will not need to be interrupted if such action is not required to prevent ink chamber failure.

According to the present invention, the part of the image still to be printed using the ink chamber will be taken into account when modifying the printing strategy. It appears to be advantageous to take into account the information still to be printed as originally envisaged when modifying the printing strategy. Let us assume, for example, that at the moment of detecting a gas bubble inside the ink chamber, this chamber is still to be used to generate a maximum number of ink drops for the remainder of the image still to be printed (for example because this ink chamber is used to print a solid area of ink). This produces a completely different situation than when this chamber is still to be used to eject, on average, one ink drop every tenth pixel for the remainder of the image (for example to form accents in the background of a landscape photograph). In the first case, the load on the chamber (in the event of an air bubble of equal size) compared to the originally envisaged actuation (according to the predetermined strategy) will need to be reduced much less than in the second case. In the latter case, it may suffice to leave out every fifth envisaged ink drop (20% fewer drops), whereas in the first case it may suffice to leave out every second drop (50% fewer drops) in the new printing strategy. This more considerable reduction will obviously also depend on the time reduction between two actuations of the ink chamber in the first case. This is because this time reduction increases the intrinsic load of the ink chamber, which causes the gas bubble to be stimulated more strongly to grow to a critical size where the chamber will fail. In order to prevent this, the load will need to be reduced relatively strongly.

The partial image still to be printed may also give rise to a modification of the printing strategy where, given the nature of the information to be printed around the one pixel, barely any to no modification of the predetermined strategy takes place, whereas at a different pixel, the strategy will be modified strongly. According to the present embodiment, the printing strategy may be modified in such a way that the maximum load of the chamber is locally sought where the obstruction will just not produce ink chamber failure.

According to the present invention, the obstruction is removed while the process of printing the image continues. In this embodiment, the possibility of removing the obstruction is used as soon as an opportunity presents itself. If the obstruction is, for example, a small contamination on the exterior of the nozzle, then this contamination may be removed between two scan actions (between which the ink chamber is at rest), for example by wiping the nozzle. If the obstruction is a gas bubble, then it may likely be possible to remove it at a time during the printing process where the ink chamber is not temporarily being used to generate ink drops (for example if there is a white area in the image). The removal will then most likely proceed passively (by the gas bubble dissolving) as known from European patent application EP 1 075 952. Once the obstruction has been removed, it is possible to continue the printing process using the printing strategy predetermined originally.

According to another embodiment, where the obstruction is a gas bubble, the frequency and/or amplitude will be modified in such a way that the gas bubble is actively removed from the ink chamber. It has been established that a gas bubble may be actively removed from an ink chamber by targeted actuation of the converter associated with this ink chamber. This has shown that under certain conditions, a gas bubble will take on a smaller equilibrium size at a lower actuation frequency. This may be used advantageously by exposing the ink chamber to an actuation pattern in which the frequency is decreased, further and further. As such, the gas bubble may shrink until it is removed.

According to another embodiment, the presence of an obstruction inside the ink chamber is detected by the application of the electro-mechanical converter, as a sensor. Application of the converter as a sensor is known from the prior art, for example as described in EP 1 013 453 or EP 1 378 360. This involves exploiting the fact that the pressure waves generated inside the ink chamber in turn deform the electro-mechanical converter. This deformation causes the converter to generate an electrical signal. By measuring this signal as a function of time, information may be obtained on the state of the ink chamber, as the pressure waves generated inside the ink chamber will be directly dependent on the state of the ink chamber. If, for example, there is a gas bubble inside the ink chamber, then a different pressure wave will be generated by actuation of the converter compared to when there is no gas bubble present. This difference in pressure wave produces a difference in deformation of the converter, which in turn produces a different electrical signal. By analyzing this signal (as is also known from EP 1 013 453), it is possible to obtain information on the obstruction inside the ink chamber.

Where the inkjet printer comprises a plurality of ink chambers and where the application of the printing strategy produces a loss of printed pixels that would originally have been formed by the ink drops originating from the ink chamber in which the obstruction is present, this loss will at least be partially compensated for by ink drops from one or more of the other ink chambers. According to this embodiment, the inkjet printer comprises, for example, a printhead with some tens to hundreds of ink chambers and associated nozzles. If an obstruction is present inside one of these ink chambers, the printing strategy is modified, according to the present invention, so that at least the load on this ink chamber will be modified to ensure that this ink chamber does not fail. In many cases, this modification will involve a lower load, for example by ejecting fewer ink drops from this ink chamber than originally envisaged when forming the image. This may cause part of the information on the image to be lost. However, in this embodiment, this information, or at least some of it, is printed by ink drops originating from one or more of the other ink chambers. These chambers will therefore be subjected to a higher load than when using the predetermined printing strategy. The extent to which the other ink chambers may be able to take over this function will, of course, depend to a large extent on the printhead configuration, the movement of the printhead relative to the carrier, the amount of loss to be compensated, the load originally envisaged for the other ink chambers, etc.

The method according to the invention is applied when printing a two-dimensional image onto a carrier where more than 50% of the carrier is covered with ink and, in particular where more than 70% of the carrier is covered. It is known that the inkjet printing process may be used to produce three-dimensional images, such as specimens prior to making final templates. The present invention may be used for printing this type of image. However, the method according to the present invention has been shown to be particularly suitable when printing flat images (i.e. relief images where the height differences in the image are typically less than 1 mm) with relatively high coverage rates, for example photographic images or displays, such as poly-LED displays, which may be formed onto a carrier by application of inkjet printers. This is because, with these high coverage rates, any failure of an ink chamber will virtually always produce print artifacts which are visible to the naked eye. Application of the present invention obviates the above problem.

The present method is also applied when printing an image in a one-pass mode. When using a so-called one-pass mode, as generally known from the prior art, there is only one nozzle (or chamber) available for each pixel in which it may be provided with an ink drop. If, therefore, a certain pixel is not printed because its associated ink chamber has failed, it is not possible to still provide an alternative ink drop from a different chamber. In such applications, it is very important to modify the printing strategy as soon as an obstruction is detected in order to prevent failure of the ink chamber. For example when printing electronic circuits, it is important that each ink chamber remains available for printing, as any loss of a substantial part of the information to be printed will correspond to a loss in the circuit's functionality.

The present invention can also be applied in a two (or multi-) pass mode, i.e. a mode wherein two (or multi-) nozzles are available for printing a pixel. For example, a printer which uses two printheads in a row is often used to print ink of the same color. For each pixel-line both printheads are being used typically at one-half their maximum print frequency. If in this case, for example in the downstream printhead a gas bubble is detected, then this printhead could be operated at even a lower frequency which is compensated for by increasing the print frequency of the upstream printhead.

Conversely, when in the upstream printhead a bubble is detected, the downstream printhead can partially take over. In the latter case, ideally the upstream printhead continues with its original print strategy until the position is reached where the downstream printhead has started printing with its alternative print strategy.

Apart from the method described above, the present invention also relates to an inkjet printer containing a substantially closed ink chamber provided with a nozzle, said ink chamber being operationally connected to an electro-mechanical converter, and a controller is programmed to control the printer to automatically carry out the method described above. This controller does not need to form a designatable unit of the printer but rather may also be composed of several components which may or may not be programmable, and may be distributed across the printer and the printer's control units, in particular a control unit located at a distance from the printer itself.

BRIEF DESCRIPTION OF THE DRAWINGS

The present invention will now be further explained with reference to the following drawings wherein.

DETAILED DESCRIPTION OF THE INVENTION

Figure 1:
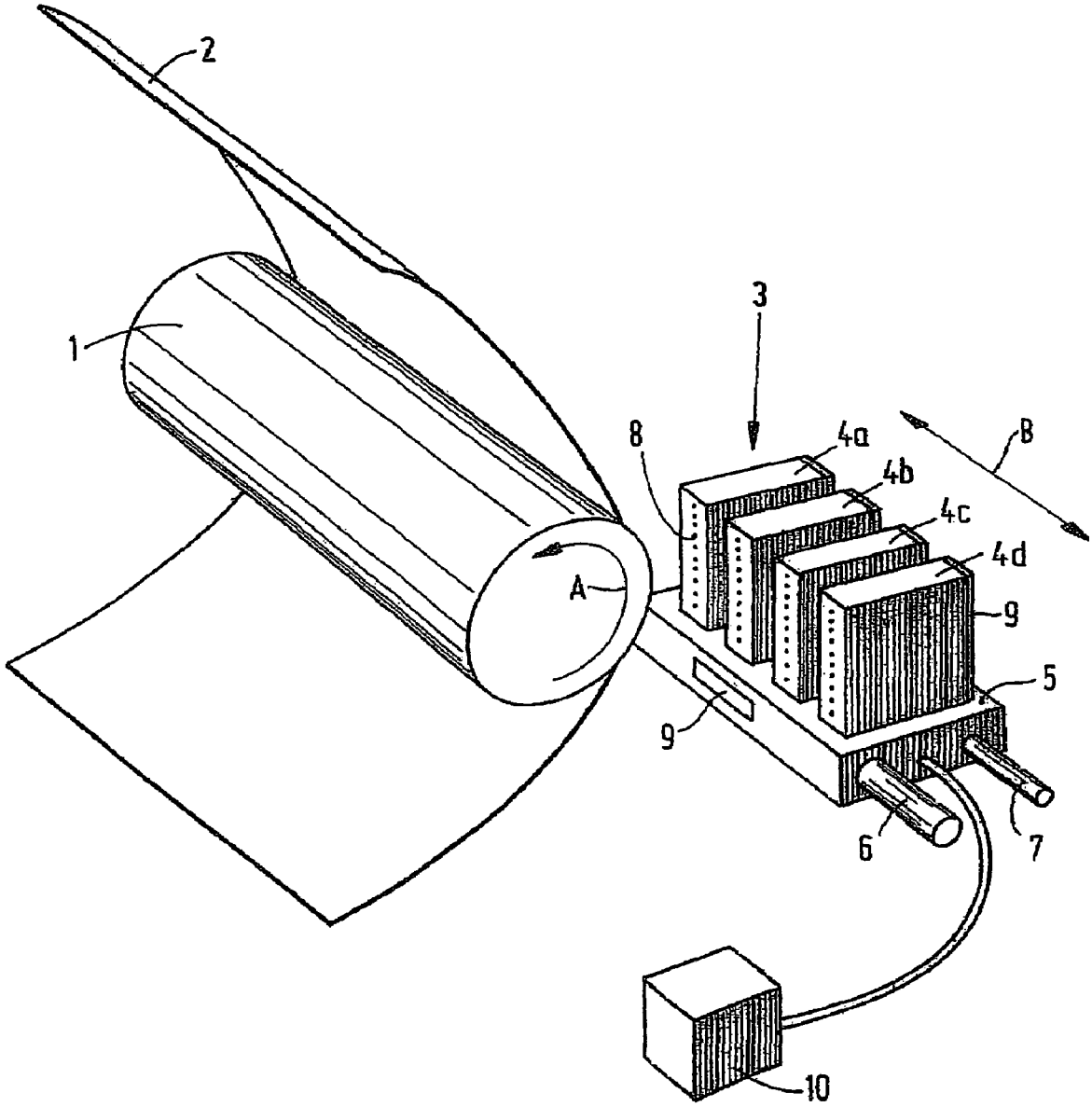
FIG. 1 is a diagram showing an inkjet printer.

FIG. 1 is a diagram showing an inkjet printer. According to this embodiment, the printer comprises a roller 1 used to support a receiving medium 2, such as a sheet of paper or a transparency which moves across the carriage 3. This carriage includes a carrier 5 to which four printheads 4*a*, 4*b*, 4*c* and 4*d* have been fitted. Each printhead contains its own color, in this case cyan (C), magenta (M), yellow (Y) and black (K), respectively. The printheads are heated using heating elements 9, which have been fitted to the rear of each printhead 4 and to the carrier 5. The temperature of the printheads is maintained at the correct level by the application of a central control unit 10 (controller).

The roller 1 may rotate around its own axis as indicated by arrow A. In this manner, the receiving medium may be moved in the sub-scanning direction (often referred to as the X direction) relative to the carrier 5, and therefore also relative to the printheads 4. The carriage 3 may be moved in reciprocation, using suitable drive mechanisms (not shown), in a direction indicated by double arrow B, parallel to roller 1. To this end, the carrier 5 is moved across the guide rods 6 and 7. This direction is generally referred to as the main scanning direction or Y direction. In this manner, the receiving medium may be fully scanned by the printheads 4.

In the embodiment as shown in the figure, each printhead 4 comprises a number of internal elongated ink chambers (not shown). These ink chambers will be referred to as ink ducts in the remainder of the description. Each of these ink ducts comprises a nozzle 8 (an exit opening for jetting ink drops). The nozzles in this embodiment form one row per printhead, perpendicular to the axis of roller 1 (i.e. the row extends in the sub-scanning direction). In a practical embodiment of an inkjet printer, the number of ink ducts per printhead will be many times greater and the nozzles will be arranged over two or more rows. Each ink duct comprises a electro-mechanical converter, in this case a piezo-electric transducer (not shown) that may generate a pressure wave inside the ink duct so that an ink drop is ejected from the nozzle of the associated duct in the direction of the receiving medium. The transducers may be actuated image-wise via an associated electrical drive circuit (not shown) by application of the central control unit 10. In this manner, an image made up of ink drops may be formed on receiving medium 2.

If a receiving medium is printed using such a printer where ink drops are ejected from ink ducts, the receiving medium, or some of it, is imagewise split into fixed locations that form a regular field of pixel rows and pixel columns. According to one embodiment, the pixel rows are perpendicular to the pixel columns. The individual locations thus produced (also referred to as pixels) may each be provided with one or more ink drops. The number of locations per unit of length in the directions parallel to the pixel rows and pixel columns is referred to as the resolution of the printed image, for example indicated as 400×600 d.p.i. ("dots per inch"). By actuating a row of printhead nozzles of the inkjet printer image-wise when it is moved relative to the receiving medium as the carrier 5 moves, an image, or some of it, made up of ink drops is formed on the receiving medium, or at least in a strip as wide as the length of the nozzle row.

Figure 2:
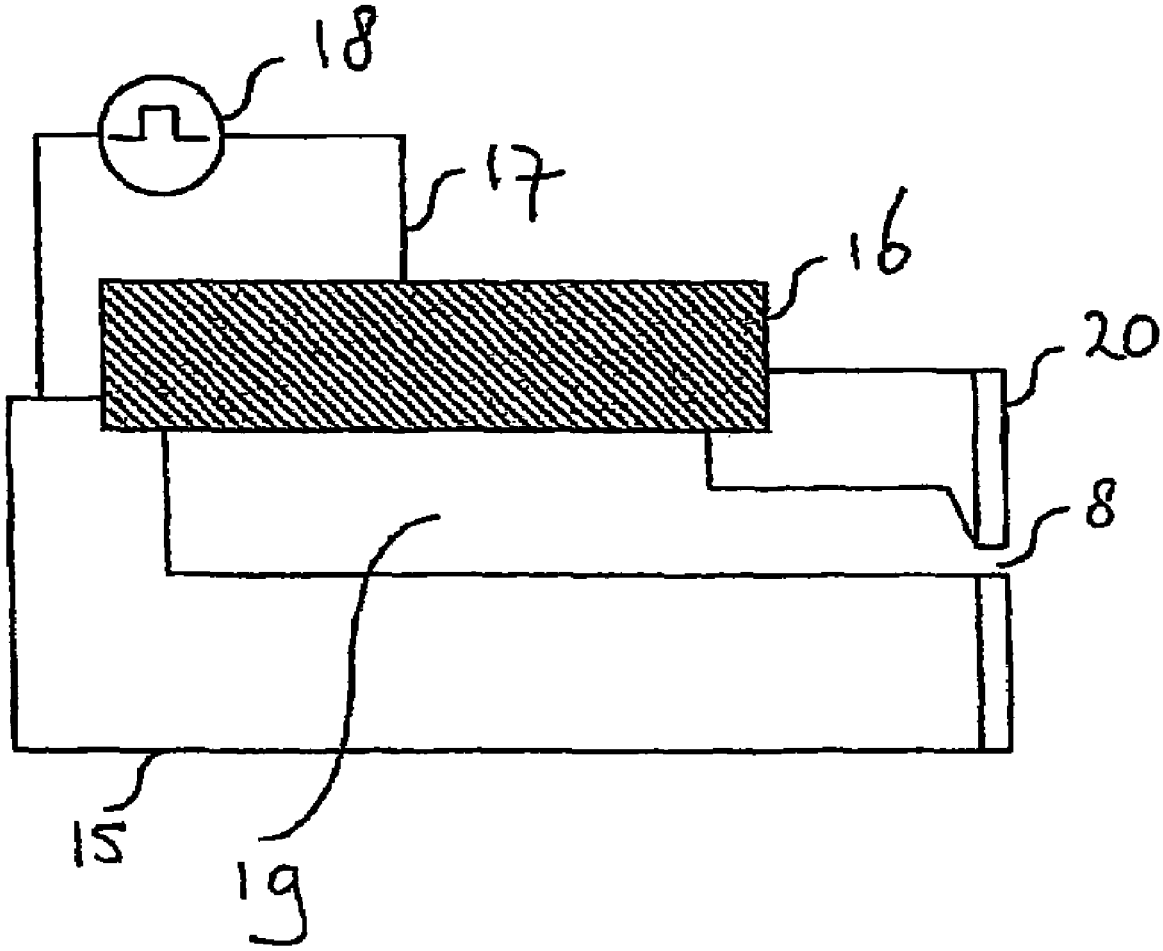
FIG. 2 is a diagram showing an ink duct assembly and its associated transducer.

FIG. 2 shows an ink duct 19 comprising a piezo-electric transducer 16. Ink duct 19 is formed by a groove in base plate 15 and is limited at the top mainly by piezo-electric transducer 16. Ink duct 19 changes into an exit opening 8 at the end, this opening being partially formed by a nozzle plate 20 in which a recess has been made at the level of the duct. When a pulse is applied across transducer 16 by a pulse generator 18 via actuation circuit 17, the transducer bends in the direction of the duct. This produces a sudden pressure rise in the duct, which in turn generates a pressure wave in the duct. According to an alternative embodiment, the transducer first bends away from the duct, thus drawing in ink via an inlet opening (not shown), after which, the transducer is moved back into its initial position. This also produces a pressure wave in the duct. If the pressure wave is strong enough, an ink drop is ejected from exit opening 8. After the expiration of the ink drop ejection process, the pressure wave, or some of it, is still present in the duct, after which the pressure wave will dampen fully over time. This pressure wave in turn results in a deformation of transducer 16, which then generates an electrical signal. This signal depends on all the parameters that influence the generation and the damping of the pressure wave. In this manner, as known from, for example, European patent application EP 1 013 453, or alternative embodiments from EP 1 378 359 and EP 1 378 360, it is possible by measuring this signal, to obtain information on these parameters, such as the presence of gas bubbles (also referred to as "air bubbles") or other obstructions in the duct. This information may then, in turn, be used to check and control the printing process.

Figure 3:
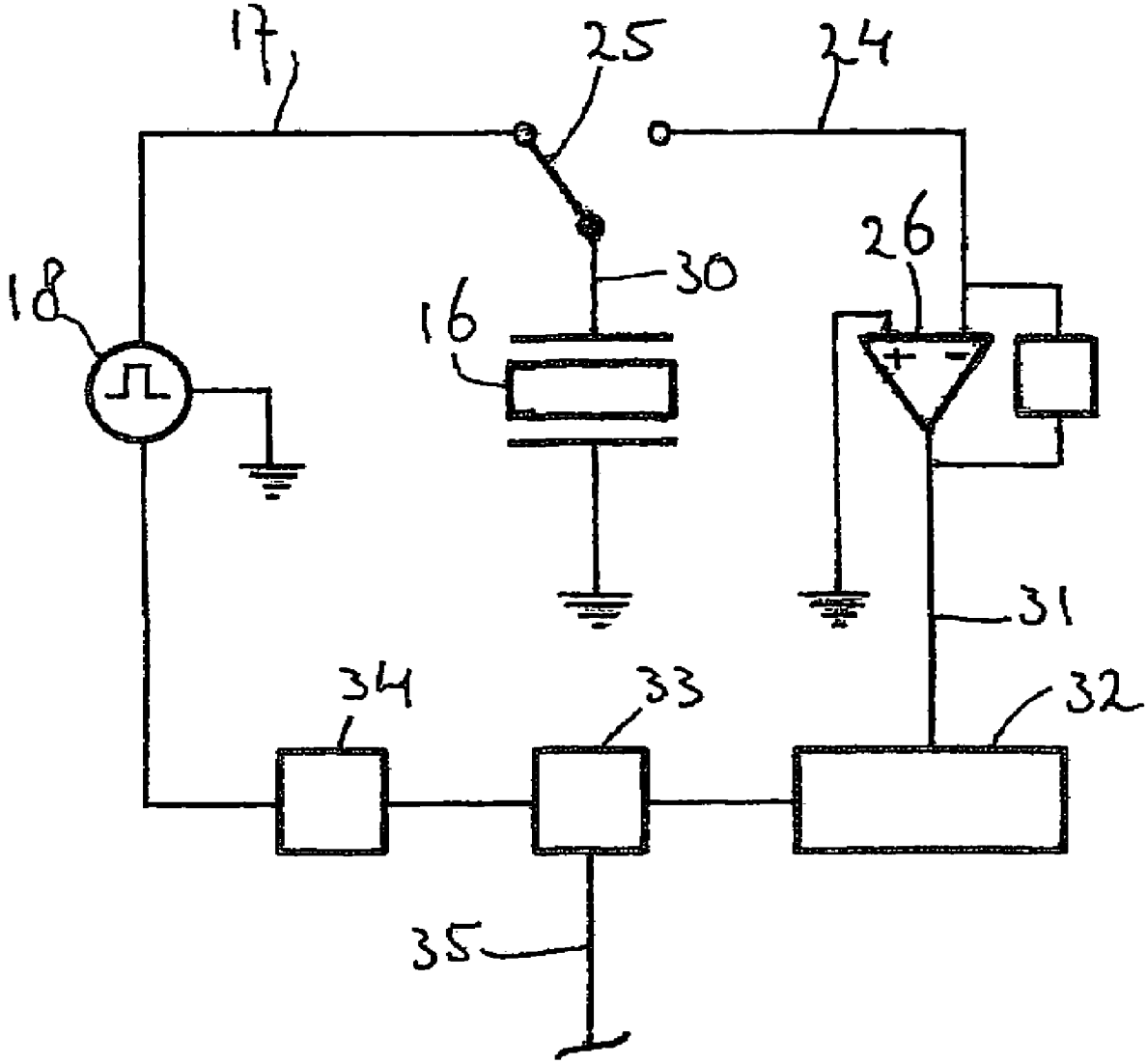
FIG. 3 is a block diagram showing a circuit that is suitable for measuring the state inside the ink duct by application of the transducer used as a sensor.

FIG. 3 is a block diagram showing the piezo-electric transducer 16, the actuation circuit (items 17, 25, 30, 16 and 18), the measuring circuit (items 16, 30, 25, 24, and 26) and control unit 33, according to one embodiment. The actuation circuit comprising a pulse generator 18 and the measuring circuit comprising an amplifier 26, are connected to transducer 16 via a common line 30. The circuits are opened and closed by two-way switch 25. Once a pulse has been applied across transducer 16 by pulse generator 18, the transducer is in turn deformed by the resulting pressure wave inside the ink duct. This deformation is converted into an electric signal by transducer 16. After the expiration of the actual actuation, two-way switch 25 is converted so that the actuation circuit is opened and the measuring circuit is closed. The electrical signal generated by the transducer is received by amplifier 26 via line 24. According to this embodiment, the resulting voltage is fed via line 31 to A/D converter 32, which offers the signal to control unit 33. This is where analysis of the measured signal takes place. If necessary, a signal is sent to pulse generator 18 via D/A converter 34 so that a subsequent actuation pulse is modified to the current state of the duct. Control unit 33 is connected to the central control unit of the printer (not shown in this figure) via line 35, allowing information to be exchanged with the rest of the printer and/or the outside world.

Figure 4:
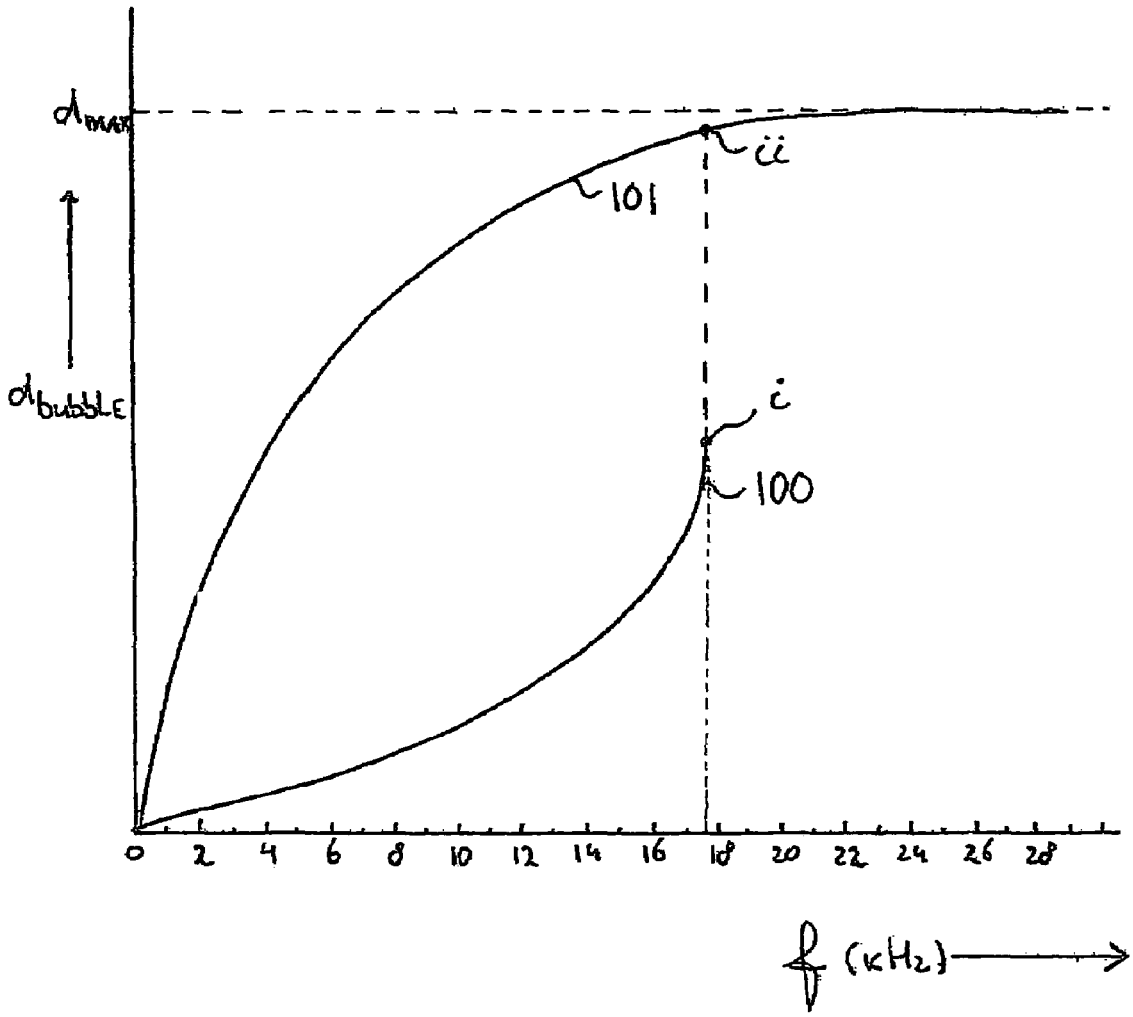
FIG. 4 shows the correlation between the size of an air bubble and the actuation frequency in equilibrium.

FIG. 4 shows a correlation 100 for the inkjet printhead described hereinabove between the size of an air bubble (vertical axis, arbitrary units) and the frequency with which the transducer of the duct with the air bubble is actuated (horizontal axis in kilohertz), where an equilibrium exists and ink drops are ejected from the duct nozzle as a result of the actuation. Research has shown that the size of an air bubble inside an ink duct where the transducer is actuated at a certain frequency will normally increase to a certain equilibrium level due to said actuations. The size of a bubble at this equilibrium level depends, among other factors on whether or not ink drops are ejected during actuation. If ink drops are ejected as a result of the actuation, the equilibrium follows curve 100. It may be seen that the curve continues up to approximately 17,500 Hz (indicated by "i" in the figure). At this frequency, the air bubble present will just not cause the failure of the ink chamber. If the frequency increases a tiny bit more, the duct will fail and ink drops will no longer be ejected, causing the size of the air bubble to increase very quickly until it reaches a size that reflects curve 101 (indicated by 'ii' in the figure). Curve 101 shows the equilibrium between the size of an air bubble and the frequency when no ink drops are ejected. The exact position of the curves depends on many factors such as the geometries of the duct and the nozzle, the ink type, the temperature of the printhead, etc. and may be determined by experimentation. The size of the air bubble itself may, for example, be derived from analyzing the signal generated by the transducer when the latter is used as a sensor (see FIGS. 2 and 3). As the size of the air bubble is an important parameter for the acoustics in the duct, this size may be derived by the application of a simple model for these acoustics by measuring the pressure wave present in the duct after the associated converter has been actuated. As is generally known, the pressure wave is directly dependent on the acoustics in the duct.

The present invention exploits the knowledge that, despite the presence of an obstruction, it may still be possible to reliably eject ink drops from the duct in many cases. In the example given, let us assume that an air bubble is detected inside an ink duct, while the predetermined printing strategy is such that this duct must be loaded at a 18,000 Hz jet frequency for the next minute. As experience has shown, at least in the case of the printhead in this example, an air bubble will grow to its equilibrium size within 20 seconds. This means that the duct will fail after approximately 20 seconds if the predetermined printing strategy is maintained (as 18,000 Hz exceeds the critical frequency of 17,500 Hz). Next, the duct will no longer be instantly available for printing, which will in all likelihood produce an unacceptable loss of information in the image. In order to prevent this, an alternative strategy will be determined after the air bubble has been detected. As such a printing strategy will take less than 1 second to calculate, the printing process using the predetermined printing strategy will not need to be interrupted immediately after the air bubble has been detected (because it will take approximately 20 seconds for the air bubble to grow to a critical value). Therefore, prior to this interruption, an alternative strategy will first be determined, whereby the printing process may be continued without the associated duct failing. In this case, the strategy may easily be modified by reducing the maximum jet frequency of the associated duct to for example 15,000 Hz (as the duct will not fail at this frequency according to correlation 100). It should be noted that 15,000 Hz is very near to the critical frequency of 17.500Hz. This could mean that the ink droplet formation process is not optimal. If so, the frequency could be lowered to e.g. 10.000 Hz. The necessity of this depends among other things on the required image quality but also on the jetting characteristics of the printhead.

As soon as this strategy has been determined, the printing process using the predetermined strategy will be interrupted. However, the printing process will immediately continue by the application of the modified printing strategy. Therefore, there is no noticeable interruption of the printing process. Furthermore, the printing strategy will be modified in such a way that the number of ink drops ejected from the duct will barely be reduced (in a solid area, for example, 1 in 18 ink drops will not be jetted). In the image, this reduction will produce little or no undesirable print artifact.

According to an alternative embodiment, the printing strategy will be modified by applying, in addition to a minor reduction in frequency, a minor change in amplitude of the actuation pulses (providing this will not produce ink duct failure). This allows slightly larger ink drops to be jetted, which may offset the loss of ink caused by the reduction in frequency.

Figure 5:
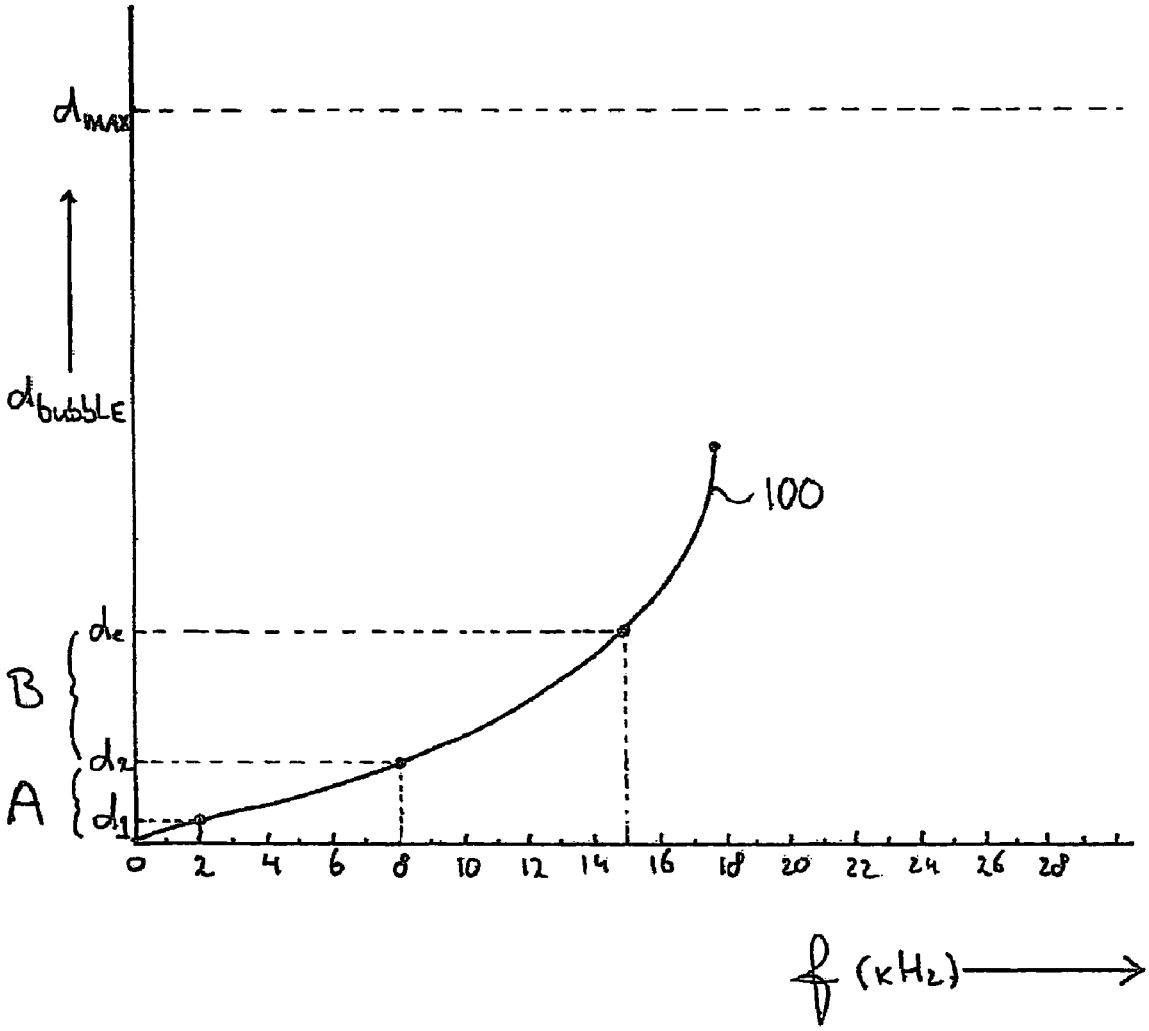
FIG. 5 shows how an air bubble that is present inside an ink duct may be actively removed.

FIG. 5 shows correlation 100 again. This example describes the manner in which an air bubble present inside an ink duct may be actively removed by performing a targeted actuation of the converter associated with the ink chamber. In this example, an ink duct of an inkjet printhead is actuated at a frequency of 20,000 Hz. While performing a scan action, an air bubble of a size between $d_2$ and $d_e$ is detected inside one of the ink chambers (in the area indicated by B). If the printing strategy were not modified, this air bubble would quickly grow until it reached a critical size and caused the duct to fail (at a frequency of 20,000 Hz, an air bubble as indicated in the figure will not be able to reach an equilibrium size according to curve 100). Thus, the predetermined printing strategy will be interrupted and modified in such a way that the air bubble will not produce ink chamber failure while the process of printing the image continues, by actuation of the converter using this modified printing strategy. To this end, it would be possible to reduce the printing frequency to 15,000 Hz so that the air bubble will take on an equilibrium size $d_e$. In this state, the ink duct will not fail but will remain available for printing. However, according to this embodiment, it is possible to use a targeted actuation sequence where the duct will continue to eject ink drops although the air bubble is also actively removed. To this end, the transducer of the associated duct will be actuated at a frequency of 8,000 Hz for 20 seconds, where the amplitude of each pulse is such that an ink drop will be ejected from the duct. These ink drops will then be applied, according to the present invention, to continue to print the image. These actuations will cause the air bubble to shrink to a size $d_2$. Next, the transducer will be actuated for 10 seconds at a frequency of 2,000 Hz, again at an amplitude high enough to ensure that ink drops are ejected from the duct. These drops too will form pixels of the image in question on the carrier. This second series of actuations at an even lower frequency will cause the air bubble to further shrink to a size $d_1$. An air bubble of this size may be deemed to have been removed as it is so small that it will disappear during printing, for example by being ejected from the duct together with an ink drop. As the obstruction has now been removed, the modified printing strategy may be abandoned and the printing process may be resumed by application of the predetermined printing strategy. A major advantage of this embodiment is that the obstruction will quickly disappear so that only a very small part of the image needs to be printed by application of the modified printing strategy, which might involve a minor loss of information. Next, the remainder of the image may be printed again using the predetermined strategy.

Figure 6:
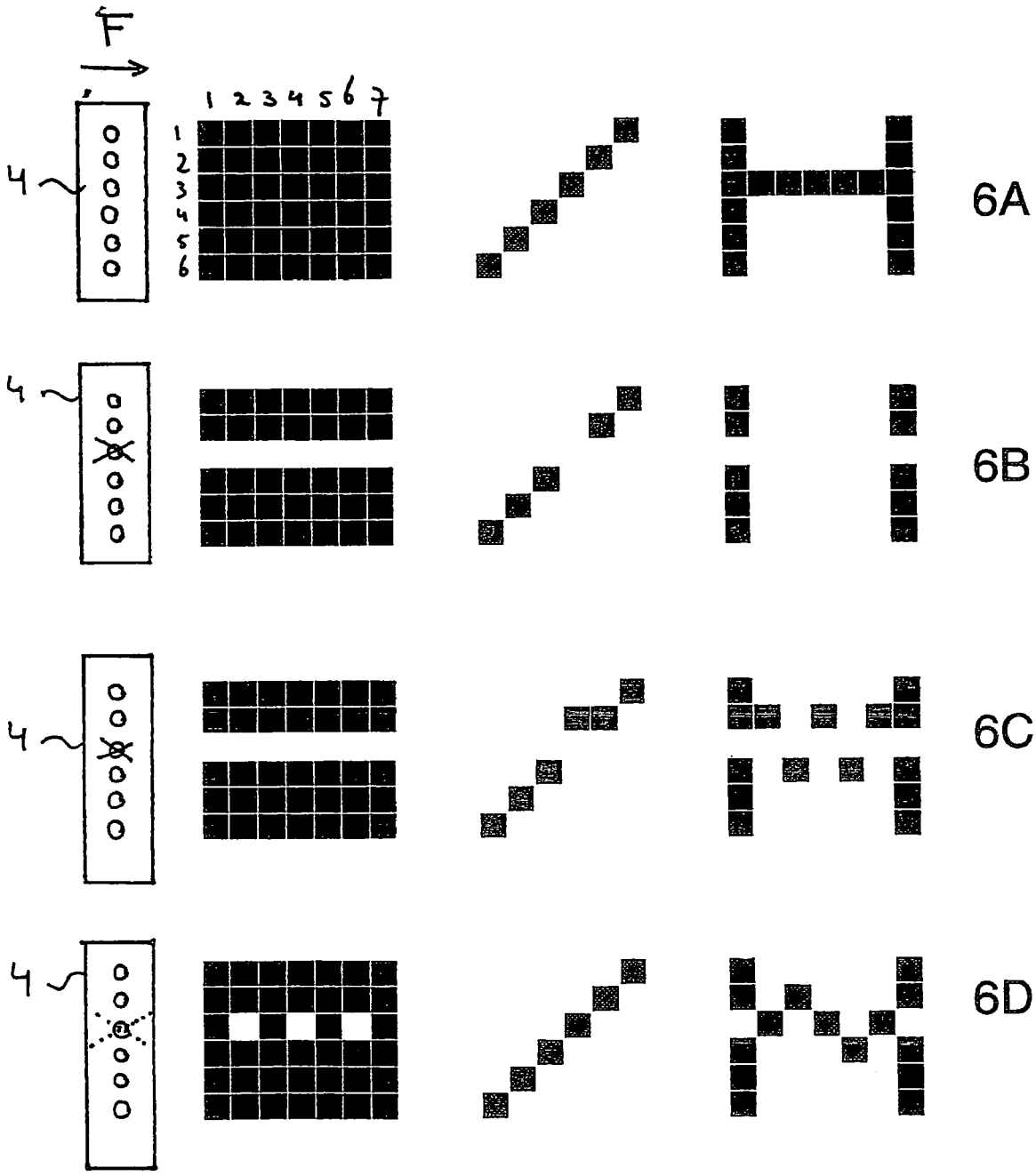
FIG. 6 is a diagram showing a number of images which have been printed onto a carrier by the application of various methods.

FIG. 6 shows a number of images which have been printed onto a carrier. In each of the images, a pixel which has been provided with an ink drop has been indicated by a little black square. The pixels that have not been printed and those that fall outside the image have been indicated by a little white square (so that they will disappear as a white area against the white background).

FIG. 6A shows the image as it is presented for printing. The image is made up of three part images, i.e. (from left to right) a solid square made up of 42 pixels (7pixel columns×6 pixel rows), a diagonal line made up of 6 pixels and the letter H made up of 17 pixels. This image may easily be printed using a properly functioning printhead 4 containing a row of 6 nozzles (coinciding with the 6 pixel rows making up the image), by moving it once along the carrier in the direction indicated by F by actuating the associated ink chambers image-wise.

FIG. 6B shows that one ink duct, i.e. the duct that corresponds to the third pixel row, contains an obstruction that has led to failure of this duct (shown by a cross of solid lines drawn through the nozzle associated with this duct). If this printhead is required to print the same image, it will not be possible for one entire line of the image to be provided with ink drops. This will produce a highly undesirable print artifact, particularly in the solid area and at letter H.

FIG. 6C shows a solution provided for this problem as known from the prior art, for example, from U.S. Pat. No. 6,270,187, where the information associated with pixels that cannot be printed due to failure of their associated ink duct will be transferred to adjacent ducts. This will not be an improvement for the solid area. As the adjacent ducts are already fully loaded, they will not be able to jet additional ink drops to compensate for the loss of information. At the diagonal line and letter H, there will be some improvement but the chance of producing a visible print artifact will continue to be relatively high here.

FIG. 6D shows the image which may be printed by application of the method according to the present invention. Thus, if it is known that a small air bubble is present inside the ink duct (which may be detected after jetting the first ink drops for the first pixel column of the solid area by application of the analysis method described with reference to FIGS. 2 and 3), the maximum jet frequency of this duct will immediately be reduced to one-half of its value (as it is known in this case that an air bubble will then not produce failure of this duct). This has been shown in FIG. 6D by the cross of dotted lines. This means that the second pixel of the third row of the solid area will not be printed. As far as the remaining pixels of the third row are concerned, no two pixels adjacent to one another may be printed. This will mean that the solid area will have a number of unprinted pixels. However, the diagonal line may in any case be printed without any print artifact as the pixel that is to be printed using the duct in which the air bubble is present, will not immediately follow or proceed another pixel to be printed. As far as the letter H is concerned, half of the pixels from the horizontal line may be provided with an ink drop. In the embodiment shown, part of the information missed will be transferred to the adjacent ink ducts. This letter H will show a print artifact that will be less noticeable in the image than the artifact of the letter H as described with respect to FIG. 6C.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing method for application in an inkjet printer containing a substantially closed ink chamber provided with a nozzle, said ink chamber being operatively connected to an electro-mechanical converter, said method comprising the steps of:

printing an image for the purposes of which the converter is actuated according to a predetermined printing strategy in order to eject ink drops from the nozzle for the formation of the image on a carrier, detecting the presence of an obstruction inside the ink chamber during the printing process, followed by interrupting the printing process, wherein the method further comprises:

modifying the printing strategy in such a way that the obstruction will not produce ink chamber failure while the process of printing the image continues by the actuation of the converter using the modified printing strategy, and continuing the printing process by the application of the modified printing strategy.

2. The method according to claim 1, wherein the predetermined printing strategy is modified by changing the frequency at which the converter is actuated.

3. The method according to claim 1, wherein the printing process is automatically interrupted when it is detected that the process of printing the entire image by application of the predetermined printing strategy would produce ink chamber failure during this printing process.

4. The method according to claim 1, wherein the part of the image still to be printed using said ink chamber will be taken into account when modifying the printing strategy.

5. The method according to claim 1, wherein the obstruction is removed while the process of printing the image continues.

6. The method according to claim 5, where the obstruction is a gas bubble, and the frequency and/or amplitude are modified in such a way that the gas bubble is actively removed from the ink chamber.

7. The method according to claim 1, wherein the obstruction is a gas bubble.

8. The method according to claim 1, wherein the presence of an obstruction inside the ink chamber is detected by the application of the electro-mechanical converter as a sensor.

9. The method according to claim 1, wherein the inkjet printer comprises a plurality of ink chambers and where the application of the printing strategy produces a loss of printed pixels that would originally have been formed by the ink drops originating from the chamber in which the obstruction is present, this loss will be at least partially compensated by ink drops from one or more other ink chambers.

10. The method according to claim 9, which is applied when printing an image in a multipass mode comprising; a first pass and one or more other passes;

wherein the chamber in which the obstruction is present is used for the ejection of ink drops during the first pass and one or more other ink chambers are used for the ejection of ink drops during one or more other passes.

11. The method according to claim 1, which is applied when printing a two-dimensional image onto the carrier where more than 50% of the carrier is covered with ink and, in particular where more than 70% of the carrier is covered with ink.

12. The method according to claim 1, which is applied when printing an image in one-pass mode.

13. An inkjet printer comprising a substantially closed ink chamber containing a nozzle, said ink chamber being operationally connected to an electro-mechanical converter, and a controller which has been programmed to control the printer to automatically carry out the method of claim 1.

* * * * *